US006532706B1

(12) United States Patent
Scott et al.

(10) Patent No.: US 6,532,706 B1
(45) Date of Patent: Mar. 18, 2003

(54) GRIDLESS CEILING SYSTEM

(76) Inventors: Joseph H. Scott, 100 Parker Ave., Manasquan, NJ (US) 08736; Ruth A. Scott, 100 Parker Ave., Manasquan, NJ (US) 08736

( * ) Notice: Subject to any disclaimer, the term of this patent is extended or adjusted under 35 U.S.C. 154(b) by 0 days.

(21) Appl. No.: 09/996,433

(22) Filed: Nov. 20, 2001

(51) Int. Cl.[7] ..... E04C 2/52
(52) U.S. Cl. ..... 52/220.6; 52/506.07; 52/506.08
(58) Field of Search ..... 52/506.06, 506.07, 52/506.08, 726.1, 726.2, 220.6

(56) References Cited

U.S. PATENT DOCUMENTS 3,863,413 A * 2/1975 Moomey ..... 52/506.07
3,898,782 A * 8/1975 Donato ..... 52/506.08
5,619,833 A * 4/1997 Neff ..... 52/506.07

* cited by examiner

*Primary Examiner*—Carl D. Friedman
*Assistant Examiner*—Steve Varner
(74) *Attorney, Agent, or Firm*—Clifford G. Frayne

(57) ABSTRACT

A gridless drop ceiling assembly having ledger boards mounted on opposing longitudinal walls of a room and extending the length of the opposing longitudinal walls, the ledger boards being mounted proximate to the height of the desired drop ceiling and in parallel relationship, a plurality of mounting studs positioned on the ledger boards, the mounted studs extending outwardly from the surface of the ledger boards, the mounting studs on opposing ledger boards being in aligned relationship, a plurality of ceiling beams generally rectangular in cross section having parallel upper and lower surfaces and parallel side surfaces and parallel opposing end surfaces, the ceiling beams dimensioned to the distance between the ledger boards, the ceiling beams having formed in the opposing end surfaces thereof an L-shaped slot in communication with one surface of the ceiling beam, the L-shaped slot having a depth at least equal to the height of the mounting stud on the ledger board for the slidable positioning of and locking of the opposing mounting studs into the mounting slots at opposing ends of the ceiling beam and a plurality of ceiling inserts supported by the ceiling beams forming a drop ceiling.

11 Claims, 4 Drawing Sheets

GRIDLESS CEILING SYSTEM

BACKGROUND OF THE INVENTION

1. Field of the Invention

The present invention relates generally to assemblies for installing a drop ceiling, and more particularly to such an assembly or system which does not require a suspended grid or hanger wires.

2. Description of the Prior Art

Conventional systems for providing what are commonly referred to as drop ceilings are a series of suspended main runners arranged in parallel relationship, there being perpendicular cross runners in cooperation with the main runners to form a grid pattern of open square apertures or rectangular apertures. Both the main runner and cross runners are of an inverted T cross-section such that the horizontal portion of the main runners and cross runners are able to support a ceiling tile about its periphery. In such a system at least the main runners are secured at a fixed distance below the bottom of the floor joists by hangers which extend between the joists and the vertical portions of the runners.

For the installation of ceiling tiles in such a system, the tiles are tilted, inserted upwardly through one of the apertures in the grid and then adjusted to the horizontal plane and allowed to drop into place between the main runners and the cross runners. This procedure is reversed to remove tiles for replacement or repair. Such a system results in a visible grid of main runners and cross runners with the ceiling tile filling the grid apertures. Most people associate acoustic tile when considering a drop, grid ceiling. However, other light weight materials can be utilized in a grid ceiling of the prior art. However, other materials are becoming available for use in drop ceilings, such as light metal, plastic, and fabricated wood products. Many of these new ceiling products suffer a detraction of their decorative aspects as a result of the drop grid ceiling. Applicant's invention allows the use of these new products without a grid and also allows use of these products in sizes larger than heretofore accustomed. Applicant will hereafter refer to the ceiling tiles as inserts so as not to invoke the mind set of acoustic ceiling tiles only, but rather, to encompass all types of drop ceiling materials.

Applicant's invention provides for an easy to install ceiling support which gives the user the opportunity to explore decorative ceiling aesthetics and to use a variety of different ceiling materials. Applicant's invention further gives the user the opportunity to install the ceiling so as to provide for open beam visual affect or a flush ceiling visual affect.

OBJECTS OF THE INVENTION

An object of the invention is to provide for a novel gridless ceiling system.

A still further object of the present invention is to provide for a novel ceiling system which is easily installed, and once installed can be removed and reinstalled using no tools.

A still further object of the present invention is to provide for a novel ceiling system which provides the option of an open beam visual affect or a flush ceiling visual affect.

A still further object of the present invention is to provide for a novel ceiling system which comprises only main runners which allows the longitudinal decorative treatments on the ceiling.

A still further object of the present invention is to allow the attachment of fixtures, such as fans and lights, directly to the beams, and not cut out holes in the tiles.

SUMMARY OF THE INVENTION

A ceiling system having two ledger boards attached to opposing walls running the length of the room, each ledger board having mounting studs attached intermittently along the length of the ledger board, opposing mounting studs cooperative with a cross beam having an L-shaped slot formed in opposing ends to slidably engage and lock on the mounting studs. The cross beams once positioned allow for the positioning of ceiling inserts. In one embodiment, the ceiling inserts are placed on the upper surface of the beams and in a second embodiment, each beam would have a slight flange on its lower surface to allow the ceiling inserts to be positioned flush with the lower surface of the beam. This provides the user with the option of an open beam ceiling or a flush ceiling. By requiring only cross beams, the installation is made easier and the user is provided with an uninterrupted area of ceiling running from wall to wall between the cross beams. This allows the user to provide decoration to the ceiling, such as a mural painted on the uninterrupted tiles-extending from one wall to the other between cross beams.

BRIEF DESCRIPTION OF THE DRAWINGS

These and other objects of the present invention will be better understood particularly when taken in light of the following illustrations wherein.

DETAILED DESCRIPTION OF THE DRAWINGS

Figure 1:
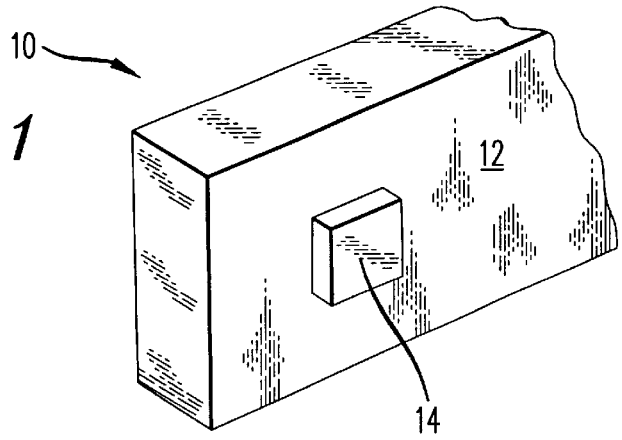
FIG. 1 is a perspective view of a ledger board with mounting studs.

FIG. 1 is a perspective view of a ledger board of the present invention. Ledger board 10 is secured by a suitable fastener means to opposing walls of the room, running the length of the room, and being secured to the walls at the desired height of the ceiling. Positioned on outer surface 12 of ledger board 10 are a plurality of spaced apart mounting studs 14. Mounting studs 14 are secured to the ledger board 10 by suitable fastening means and are in spaced apart relationship dependent upon the width of ceiling inserts to be utilized. In the instant configuration, the mounting studs 14 are illustrated as being square protrusions for cooperation with the cross beams as more fully discussed hereafter.

Figure 2:
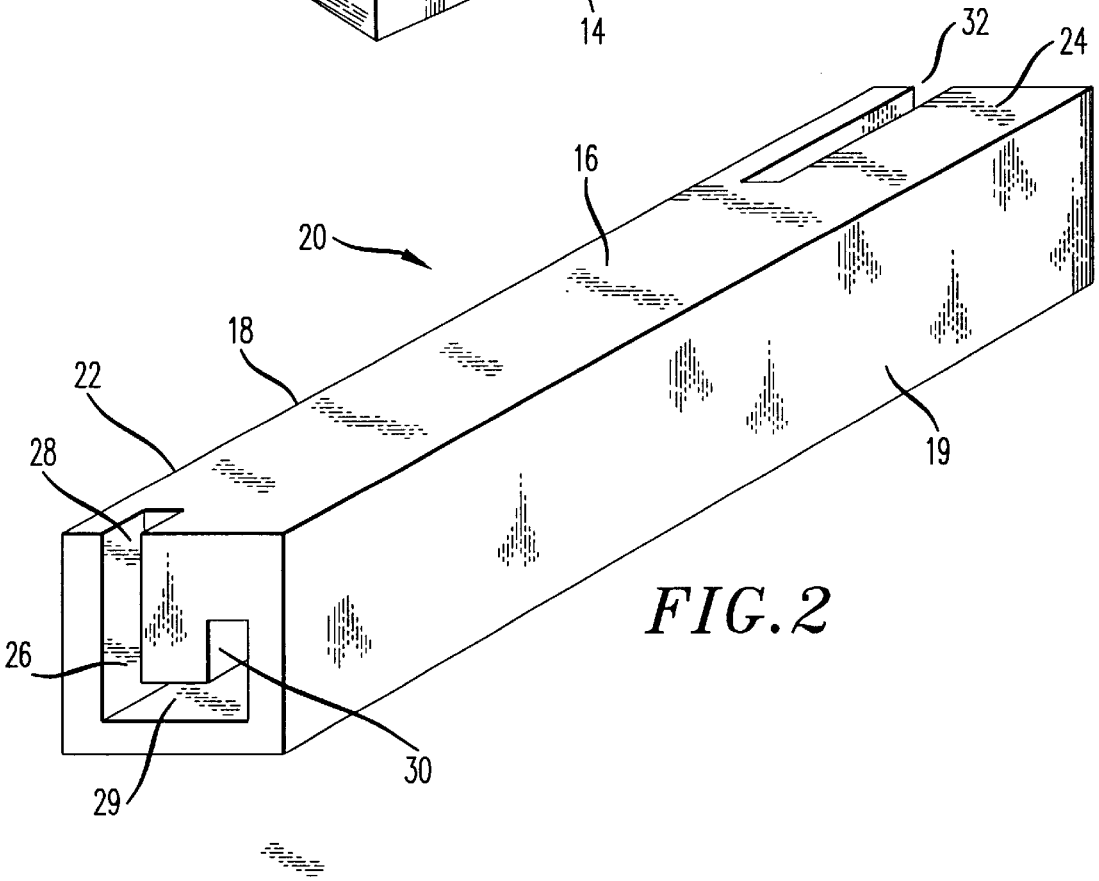
FIG. 2 is a perspective view of a cross beam.
Figure 3:
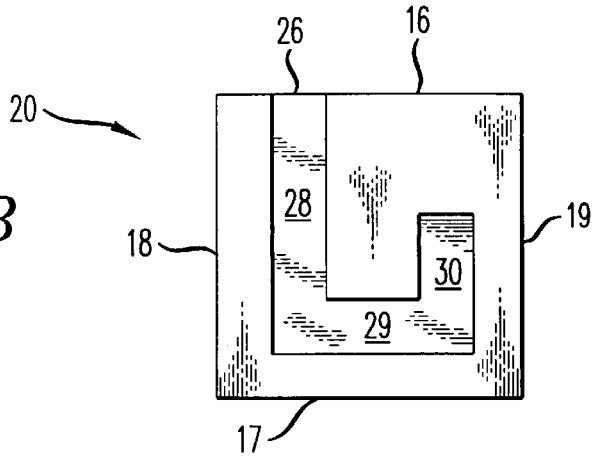
FIG. 3 is an end view of a cross beam.

FIG. 2 is a perspective view of a cross beam 20 of the present ceiling system, and FIG. 3 is an end view. The cross beam 20 is generally square in cross section and has a first end 22 and a second end 24, an upper surface 16, lower surface 17, and side walls 18 and 19. There is formed in first end 22 an L-shaped slot 26. The L-shaped slot 26 consists of a first leg portion 28 which extends from the upper surface 16 of cross beam member 20 perpendicularly towards lower surface 17 of cross beam member 20 to a point distal proximate thereto and thence a second leg 29 extending horizontally in parallel relationship with upper and lower surfaces 16 and 17 of cross member 20 to a point distal proximate to side wall surface 18; and thence a third leg 30 extends upwardly parallel to said first leg 28 terminating in a point distal proximate from upper surface 16 of cross member 20. The aforesaid slot 26 formed in the first end 22 of cross member 20 is at a depth at least equal to the depth of mounting studs 14 on ledger board 10.

An identical slot 32 is formed in second end 24 of cross beam 20. In order to accommodate rooms of varying widths with a ceiling system of the present invention, cross beam member 20 could be mass produced in a standardized length with the slot member 32 on second end 22 of cross member 20 being at a depth of one to two feet. This would permit the installer to saw off the excess of second end 24 of cross beam 20 in order to accommodate rooms of varying widths.

In order to assemble the gridless ceiling system of the present invention, the ledger boards 10 are positioned on opposing walls at the desired height with the mounting studs 14 spaced the desired distance apart. An accurate measurement from one ledger board surface 12 to the opposing ledger board surface 12 is made in order to determine the length of the cross beam. If the length of the cross beam needs to be adjusted, a portion of second end 24 is removed using conventional saw techniques. The cross beam 20 is then positioned transversely between the ledger boards with the first leg 28 of L-shaped slot 26 at both first end 22 and second end 24 of cross beam 20 in alignment with opposing mounting studs 14. The cross beam 20 is then raised upwardly such that mounting stud 14 slides within first leg 28 to a point where it engages second leg 29 of L-shaped lot 26. The cross beam 20 is then slid laterally such that mounting stud 14 travels along second leg 29 until it is in alignment with third leg 30 of L-shaped slot 26. The mounting beam is then lowered such that mounting stud 14 is now engaged in the upper portion of third leg 30. Cross beam 20 is now installed. The same procedure would be utilized for similar cross beams until all cross beams were engaged with their respective mounting studs. Inserts 27 (See FIG. 6) would then be positioned on the cross beams spanning the open space between the cross beams. In the embodiment thus far described, the cross beams are designed for an open beam ceiling and the inserts 27 would be positioned such that their peripheral lateral edges would rest on the upper surface 16 of adjacent cross beams 20.

Figure 6:
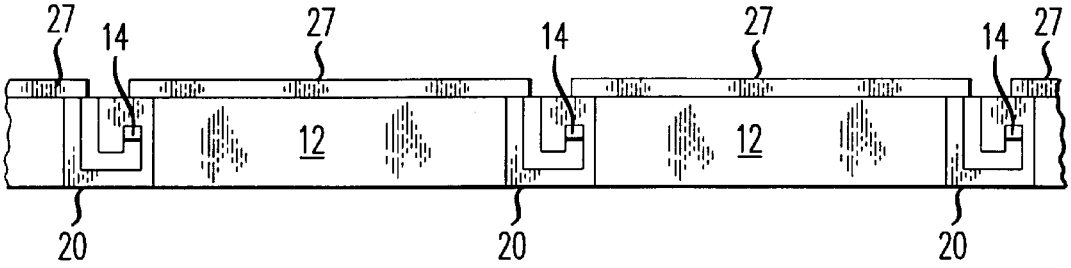
FIG. 6 is a partial cross section view of the ceiling assembly.

FIG. 6 is a side view of the ceiling assembly and inserts corresponding to surface thus far described with one of the ledger boards removed.

Figure 4:
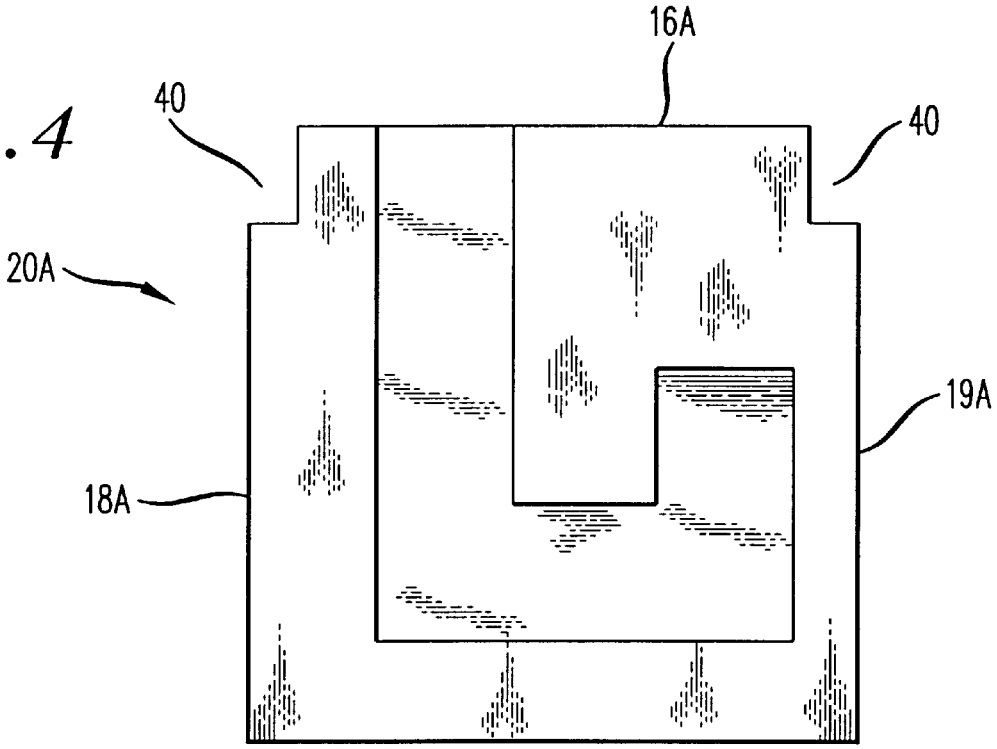
FIG. 4 is an end view of a second embodiment of a cross beam.
Figure 5:
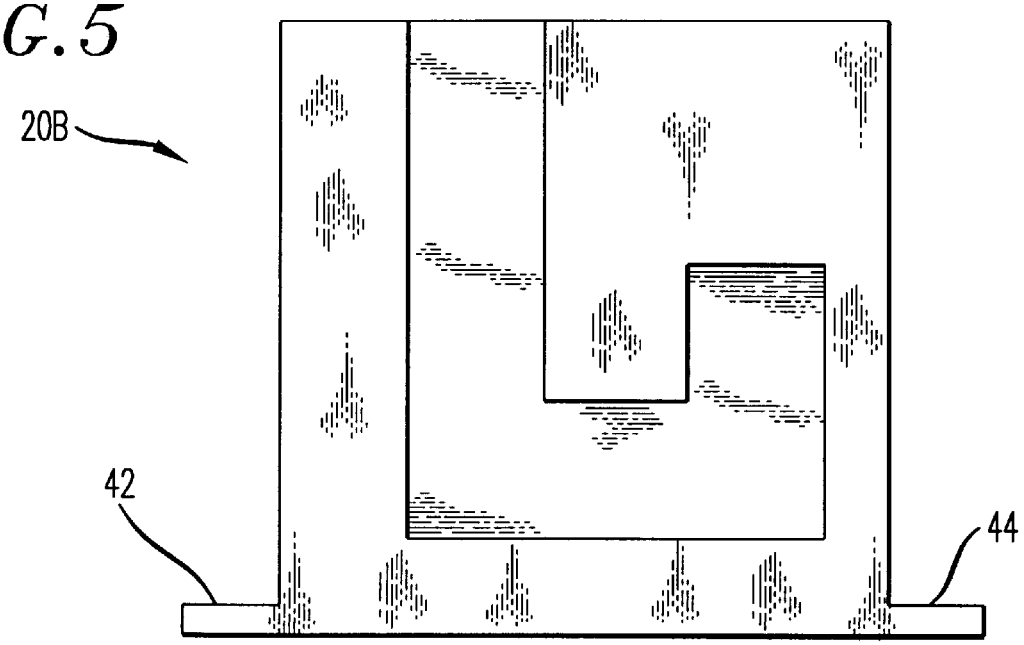
FIG. 5 is an end view of a third embodiment of a cross beam.
Figure 7:
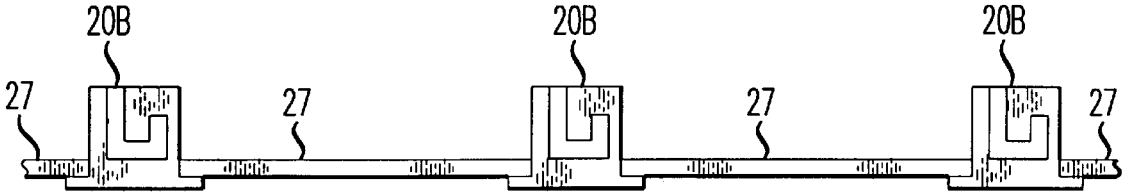
FIG. 7 is a partial cross section view of a second embodiment of the ceiling assembly.

FIGS. 4 and 5 illustrate a second and third embodiment of the cross beam member. In each embodiment, the manner of assembly of the cross beam with the mounting studs and the ledger board does not differ. The differences relate to options for positioning the inserts 27. In FIG. 4, there is disclosed a cross beam member 20A which is identical with cross beam member 20 with the exception that at the intersection of the side walls 18A and 19A with upper surface 16A, there is formed a cut out longitudinal notch 40 which would be formed in order to engage the peripheral lateral edge of an insert so positioned thereon. In FIG. 5, lower surface 17B extends beyond side walls 18B and 19B so as to form longitudinal flanges 42 and 44 along cross beam 20B. In this configuration, the ceiling insert peripheral lateral edges would rest on the flanges 42 and 44. This configuration permits the construction of a flush ceiling as opposed to the open beam ceiling achieved with the cross beam 20 and 20A. FIG. 7 is a partial cross section of a ceiling assembly utilizing cross beam 20B.

Figure 8:
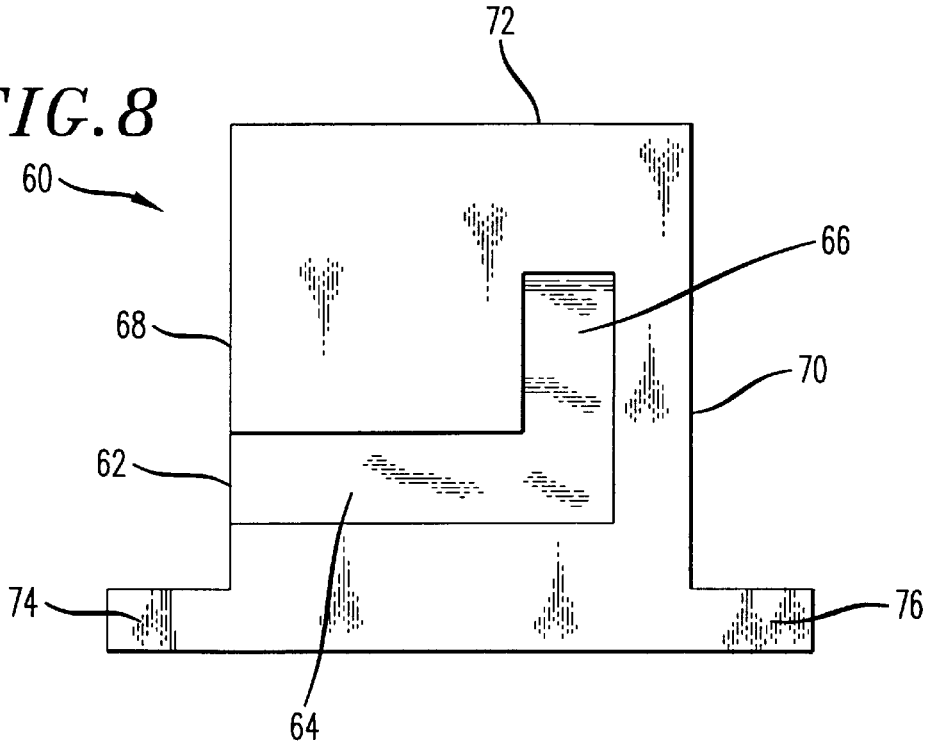
FIG. 8 is a fourth embodiment of the cross beam member for specific use with flush ceilings.

It will be noted that when assembling an open beam ceiling, L-shaped slot 26 at either end of cross beam 20 or 20A must necessarily commence at upper surface 16 of cross beam 20 or 20A so that it cannot be visible from the floor once the beam is installed. When a flush ceiling is being assembled and installed, the cross beam can be modified to provide for fewer legs in the slot since the inserts 27 will be in a substantially flush mount and block the view of the mounting method. This is illustrated in FIG. 8. FIG. 8 is an end view of a another embodiment of the cross beam identified as 60. Cross beam 60 has the same exterior configuration as cross beam 20B. However, in cross beam 60, the mounting slot 62 is comprised of two legs 64 and 66. 64 is a horizontal leg commencing on side wall 68 and extending horizontally a distance toward side wall 70. Second leg 66 extends vertically from horizontal leg 64 to a point distal proximate upper surface 72. In this configuration, mounting stud 14 is slidably receivable in horizontal leg 64 and then vertically in leg 66. Since the inserts 27 will rest on longitudinal flanges 74 and 76, the opening of slot 62 in side wall 68 will not be visible to those individuals below the ceiling.

Thus far the various embodiments of the cross beam members have been considered to be solid beams with the respective slots formed in the opposing ends thereof. Such beams lend themselves to any suitable material, including polymers or other natural or man made materials, depending upon the distance which they must span.

Figure 9:
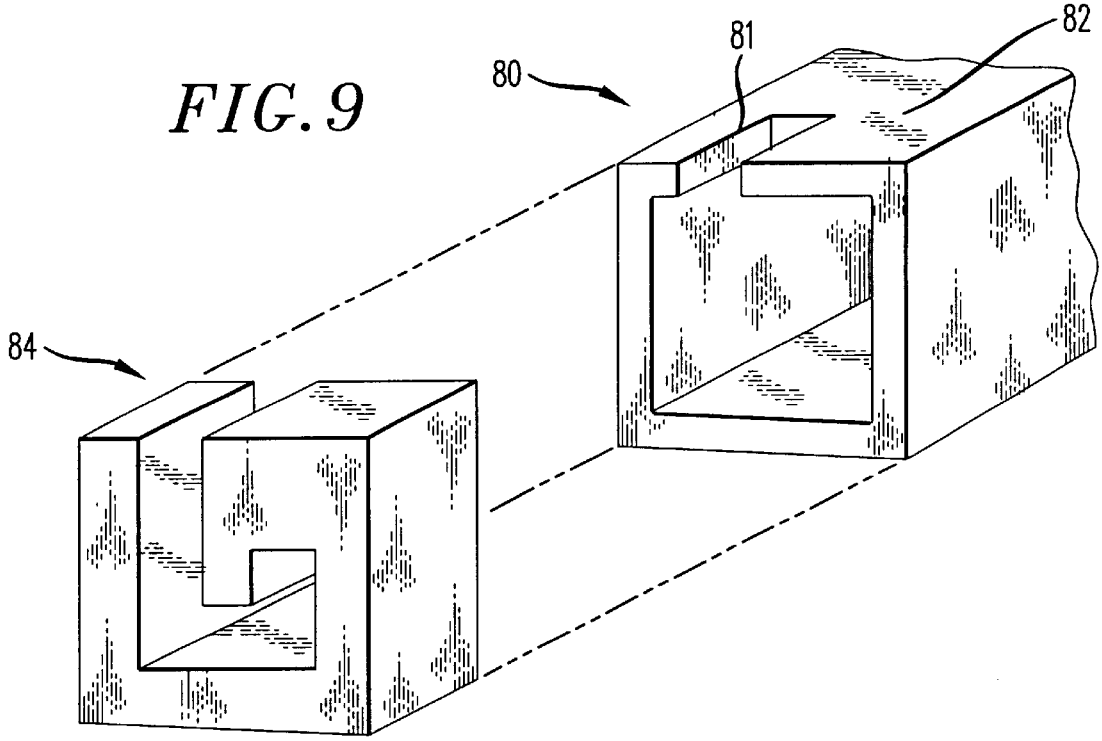
FIG. 9 is a partial perspective exploded view of a still further embodiment of the cross beam member utilized in the aforesaid ceiling assembly.
Figure 10:
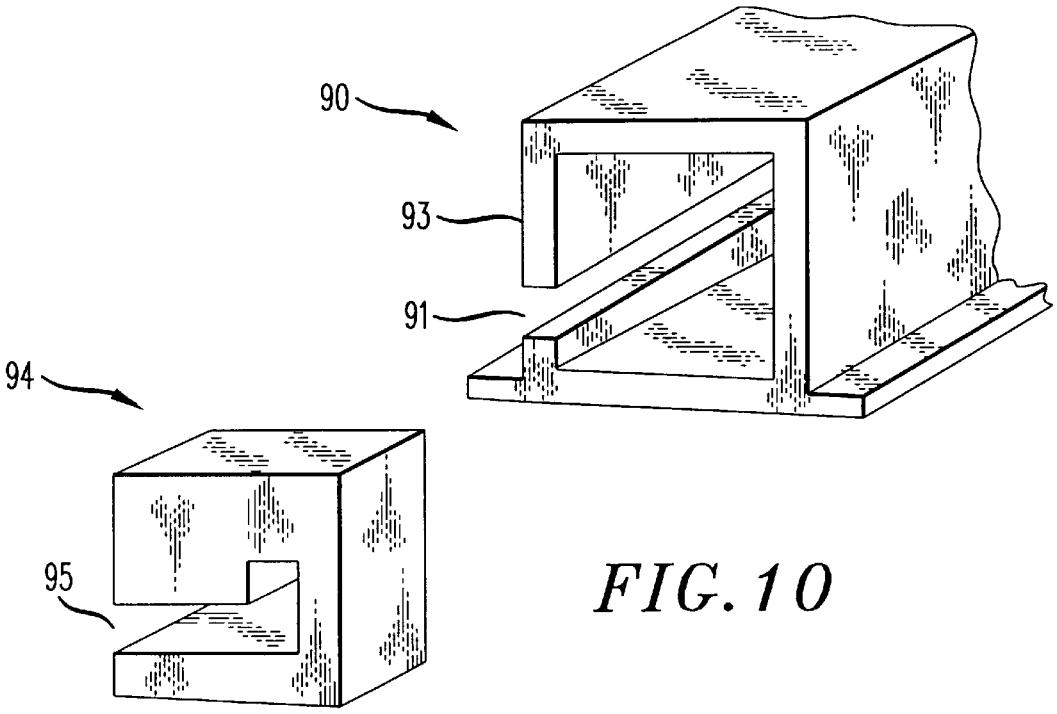
FIG. 10 is a partial perspective exploded view of a still further embodiment of the cross beam member of the ceiling assembly.

Depending upon the distance required to be spanned and the weight load, it is also possible to construct the cross beams of the present invention having a hollow construction as illustrated in FIGS. 9 and 10. FIG. 9 illustrates one end of a cross beam 80, which is tubular in construction having a rectangular cross section, the upper surface 82 of cross beam 80 would have a slot formed therein which would be at least equal to the depth of the mounting stud 14. Cross beam 80 would be adapted to mount on mounting studs 14 by securing at the ends thereof, a mounting plug 84, the thickness of which would substantially equal the depth of the mounting stud 14. As illustrated in FIG. 9, mounting plug 84 has the generally L-shaped slot 26 formed therein such that the upper portion of the slot would conform to the slot 81 formed in upper surface 82 of the cross beam member 80.

FIG. 10 is illustrative of a cross beam 90 generally tubular in nature having a rectangular cross section with flanges extending from the under surface thereof to provide for a flush ceiling. In this configuration a slot 91 is formed in the side wall 93 of cross beam 90 for the receipt of a mounting plug 94 the thickness of which is substantially identical to the depth of the mounting studs 14. In this configuration, the mounting plug 94 has a slot 95 formed therein identical to the slot formed in the cross member as illustrated in FIG. 8. Mounting plug 94 would be affixed in the opposing ends of the cross beam 90 such that the slot formed in the mounting plug would be alignable with the slot 91 formed in side wall 93. The cross beams as illustrated in FIGS. 9 and 10 would be installed in the same manner as discussed with respect to FIGS. 1, 2, 3, 4, and 5. The mounting plugs 84 and 94 could be secured within the ends of their respective cross beams by any suitable method, such as adhesives, which would not detract from the aesthetics of the beams and the resultant assembled ceiling.

While the present invention has been described with respect to the exemplary embodiments thereof, it will be recognized by those of ordinary skill in the art, and that many modifications and changes can be accomplished without departing from the spirit and scope of the invention. Therefore, it is manifestly intended that the invention be limited only by the scope of the claims and the equivalents thereof.

We claim:

1. A gridless drop ceiling assembly for a room comprising:

ledger boards mounted on opposing longitudinal walls of a room, and extending the length of opposing longitudinal walls, said ledger boards being mounted proximate to the height of the desired drop ceiling and in parallel relationship to each other;

a plurality of mounting studs positioned on said ledger boards, said mounting studs extending outwardly from a surface of said ledger boards, said mounting studs on said opposing ledger boards being in aligned relationship, said mounting studs having a circumferential, geometric shape;

a plurality of ceiling beams, generally rectangular in cross section, having parallel upper and lower surfaces, the parallel side surfaces and planar parallel opposing end surfaces, said ceiling beams dimensioned to the distance between said ledger boards, said ceiling beams having formed in opposing end surfaces thereof, an L-shaped slot in communication with one surface of said ceiling beam, said L-shaped slot having a depth at least equal to the height of said mounting studs on said ledger boards for the slidable positioning of said opposing mounting studs into the mounting slots at opposing ends of said ceiling beam;

a plurality of ceiling inserts supported by said ceiling beams forming a drop ceiling.

2. The gridless drop ceiling in accordance with claim 1 wherein said L-shaped slot formed in said opposing end surfaces of said ceiling beam are shaped having a first slot leg commencing on said upper surface of said ceiling beam and extending towards said bottom surface in parallel relationship with said side surfaces, a second slot leg commencing at the terminus of said first slot leg and extending horizontally, parallel to said lower surface to a point proximate said opposing side surface; and a third slot leg extending upwardly from said terminus of said second slot leg parallel to said side surface to a point proximate said top surface.

3. The gridless drop ceiling system in accordance with claim 2 wherein said width of said L-shaped slot formed in said opposing ends of said ceiling beams is a width corresponding to the width of said mounting stud and a depth at least equal to the height of said mounting stud.

4. The gridless drop ceiling system in accordance with claim 1 wherein said mounting stud is a four-sided geometric figure having parallel side walls.

5. The gridless drop ceiling system in accordance with claim 1 wherein said ceiling inserts are positioned on said ceiling beams such that opposing parallel edges of said ceiling inserts rest on said upper surface of adjacent ceiling beams.

6. The gridless drop ceiling system in accordance with claim 5 wherein said ceiling beams are formed with a notch at the intersection of said side surfaces and said upper surface, said notch for the receipt of a peripheral edge of said ceiling inserts.

7. The gridless drop ceiling system in accordance with claim 1 wherein said ceiling inserts positioned on said upper surface of said ceiling beams presents an open beam drop ceiling.

8. The gridless drop ceiling system in accordance with claim 1 wherein said ceiling beams are formed with a longitudinal flange on said bottom surface of said ceiling beam extending outwardly from said side surface.

9. The gridless drop ceiling system in accordance with claim 8 wherein said flanges formed on said bottom surface of said ceiling beam support a peripheral edge of a ceiling insert between adjacent ceiling beams.

10. The gridless drop ceiling system in accordance with claim 9 wherein said ceiling beam is formed with said L-shaped slot in opposing ends thereof, said L-shaped slot comprising a first slot leg in communication with one of said side surfaces of said ceiling beam, said first slot leg extending towards said opposing side surface in parallel relationship with said lower surface, a second slot leg commencing at the terminus of said first leg and extending upwardly parallel to said side surface to a point proximate said upper surface, said slot dimensioned to the width of said mounting stud.

11. The gridless drop ceiling system in accordance with claim 10 wherein said ceiling beams and said ceiling inserts create a flush beam drop ceiling.

* * * * *